US006363819B1

(12) United States Patent
Li

(10) Patent No.: US 6,363,819 B1
(45) Date of Patent: Apr. 2, 2002

(54) KNOCKDOWN HAND TOOL STRUCTURE

(75) Inventor: Yang-Ming Li, Changhua (TW)

(73) Assignee: Hung Yu Industrial Co., Ltd. (TW)

( * ) Notice: Subject to any disclaimer, the term of this patent is extended or adjusted under 35 U.S.C. 154(b) by 0 days.

(21) Appl. No.: 09/661,317

(22) Filed: Sep. 13, 2000

(51) Int. Cl.[7] ..... B25B 23/00
(52) U.S. Cl. ..... 81/438; 81/439
(58) Field of Search ..... 81/177.2, 437, 81/438

(56) References Cited

U.S. PATENT DOCUMENTS 1,203,853 A * 11/1916 Contal ..... 81/177.2
1,269,413 A * 6/1918 Finnigan ..... 81/177.2
4,399,723 A * 8/1983 Marleau ..... 81/437
4,409,866 A * 10/1983 McBride ..... 81/177.2
4,586,406 A * 5/1986 Howard ..... 81/177.2
5,732,606 A * 3/1998 Chiang ..... 81/177.2
5,836,223 A * 11/1998 Lin ..... 81/177.2 X
5,931,065 A * 8/1999 Jackson et al. ..... 81/177.2
5,964,132 A * 10/1999 Chen ..... 81/177.2 X

* cited by examiner

*Primary Examiner*—James G. Smith
(74) *Attorney, Agent, or Firm*—Bacon & Thomas, PLLC

(57) ABSTRACT

A knockdown hand tool structure. The structure includes a grip, a screwdriver stem, a fitting post and a socket. A front end of an elongated stem of the grip is formed with a central hexagonal fitting hole with a certain depth. A stop sleeve is fitted on the front end of the elongated stem. A steel ball and a compression spring are received in the stop sleeve. The screwdriver stem is a hexagonal stem body. Two ends of the screwdriver stem are respectively equipped with different specifications or patterns of screwdriver heads. Certain portions of the body of the screwdriver stem are formed with annular engaging grooves with V-shaped cross-section and a certain depth at equal intervals. The fitting post is a short cylindrical body.

3 Claims, 7 Drawing Sheets

KNOCKDOWN HAND TOOL STRUCTURE

BACKGROUND OF THE INVENTION

The present invention relates to a knockdown hand tool structure in which by means of V-shaped annular engaging grooves of the screwdriver stem, the projecting length thereof can be changed for application to various holes with different depths and diameters so as to tighten or untighten a screw or a nut. The use and replacement of the screwdriver stem are facilitated and quickened and the cost for additional screwdriver stem is saved. Also, the occupied room is reduced to facilitate carriage of the hand tool.

FIG. 1 shows a conventional hand tool including a grip 10 and a socket 50. The grip 10 is connected with a stem 11 forward projecting from the center of the front end face of the grip 10 by a certain length. The front end section of the stem 11 is formed with a rectangular fitting section 12. A steel ball 13 is inlaid in one side of the fitting section 12. The rear end of the socket 50 is formed with a rectangular fitting hole 51. The front end of the socket 50 is formed with a polygonal tool socket 52.

When assembled, as shown in FIG. 2, the fitting section 12 of the grip 10 is fitted into the fitting hole 51 of the socket 50 with the steel ball 13 engaged with the socket 50 so as to fix the socket 50 with the grip 10. When replacing the socket 50 with another with different specification, the socket 50 is directly drawn outward and separated from the grip 10.

The above conventional hand tool has some shortcomings as follows:

1. The fitting section 12 of the grip 10 can be only fitted with the socket 50 and cannot be co-used with different screwdriver stems with various specifications or types of screwdriver heads. Therefore, the application range is narrower.
2. The stem 11 of the grip 10 is not adjustable in length. Therefore, in use, it is necessary to replace the grip 10 with different length of stem 11 in accordance with the requirement of application situation. This is troublesome and inconvenient. Also, it is necessary to purchase various kinds of grips 10 and the cost is increased.

FIG. 3 shows another type of conventional hand tool including a grip 20, a screwdriver stem 30, a fitting stem 40 and a socket 50. The grip 20 is connected with a hexagonal stem 21 forward projecting from the center of the front end face of the grip 20 by a certain length. The front end section of the stem 21 is connected with an enlarged fitting head 22. The front end of the fitting head 22 is formed with a central hexagonal fitting hole 23. A steel ball 24 is inlaid in one side of the fitting hole 23. The screwdriver stem 30 is a hexagonal stem body. The front end of the screwdriver stem 30 is formed with a cross-shaped screwdriver head 31. (The screwdriver head 31 can be otherwise shaped.) The fitting stem 40 is a hexagonal stem body having a rectangular fitting section 41 at front end. A steel ball 42 is inlaid in one side of the fitting section 41. The rear end of the socket 50 is formed with a rectangular fitting hole 51. The front end of the socket 50 is formed with a polygonal tool socket 52.

When assembled, as shown in FIG. 4, the rear section of the screwdriver stem 30 is inserted into the fitting hole 23 of the fitting head 22 of the grip 20. By means of the steel ball 24 in the fitting hole 23, the screwdriver stem 30 is fixedly engaged with the grip 20 for use of the screwdriver stem 30. When applied to a nut, as shown in FIG. 5, the screwdriver stem 30 is first extracted from the fitting hole 23. Then the rear section of the fitting stem 40 is inserted into the fitting hole 23 of the fitting head 22 of the grip 20. By means of the steel ball 24 in the fitting hole 23, the fitting stem 40 is fixedly engaged with the grip 20. Then the fitting section 41 of the fitting stem 40 is fitted into the fitting hole 21 of rear end of the socket 50. By means of the steel ball 42 of the fitting section 41, the fitting stem 40 is fixedly engaged with the socket 50 for use of the socket 50.

The above conventional hand tool has some shortcomings as follows:

1. The fitting head 22 of the stem 21 of the grip 20 is enlarged. In the case that the screwdriver stem 30 is used to tighten a screw into a narrower hole with smaller inner diameter, the fitting head 22 may be stopped by the outer edge of the hole to make the screwdriver stem 30 impossible to extend to the screw.
2. When it is desired to further use the screwdriver stem 30 after using the socket 50, it is necessary to extract the fitting stem 40 and the socket 50 and then again insert the rear section of the screwdriver stem 30 into the fitting hole 23 of the fitting head 22 of the grip 20. Such procedure is troublesome and time-consuming.
3. The stem 21 of the grip 20 has fixed length which cannot be adjusted. Therefore, in use, it is necessary to replace the screwdriver stem 30 or fitting stem 40 with one with different length or specification or pattern in accordance with the requirement of application situation. This is troublesome and inconvenient. Also, it is necessary to purchase various kinds of screwdriver stems 30 and fitting stems 40 so that the cost is increased.

SUMMARY OF THE INVENTION

It is therefore a primary object of the present invention to provide a knockdown hand tool structure in which in the case that a screw is tightened in a narrower hole, the body of the screwdriver stem is slender and has unified diameter so that the screwdriver stem can easily extend into the narrower hole to drive the screw.

It is a further object of the present invention to provide the above knockdown hand tool structure in which the fitting post and the socket are fitted on the screwdriver head of the screwdriver stem. In the case that it is desired to further use the screwdriver stem after using the socket, a user only needs to extract the fitting post and the socket and then the screwdriver stem can be directly used. Therefore, it is no more necessary to extract the socket and then insert the screwdriver stem and the replacement is facilitated and quickened.

It is a further object of the present invention to provide the above knockdown hand tool structure in which in use, the screwdriver stem can be directly inward or outward moved to change the length thereof as necessary. Alternatively, the screwdriver stem can be extracted and turned over to use the other screwdriver head with different specification or pattern. Therefore, the use is facilitated and it is unnecessary to purchase additional screwdriver stem so that the cost is saved and the occupied space is reduced to facilitate carriage of the hand tool.

The present invention can be best understood through the following description and accompanying drawings wherein:

BRIEF DESCRIPTION OF THE DRAWINGS

FIG. 7-A is a sectional view showing that the stop sleeve of the present invention is pressed down and released.

DETAILED DESCRIPTION OF THE PREFERRED EMBODIMENT

Figure 1:
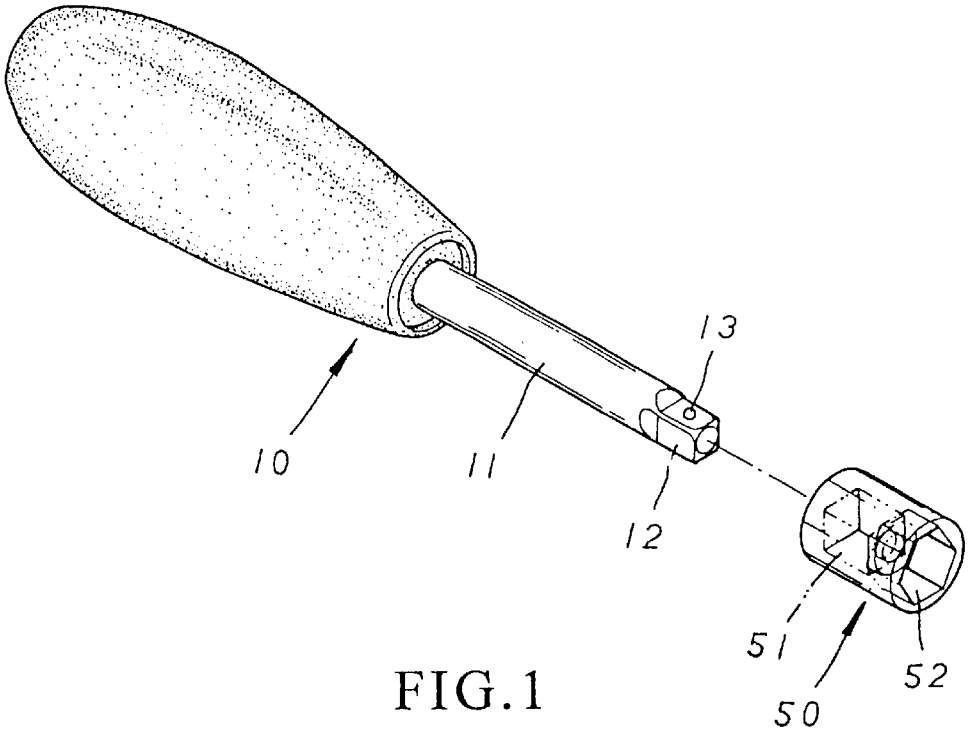
FIG. 1 PRIOR ART
FIG. 1 is a perspective exploded view of a conventional hand tool.
Figure 2:
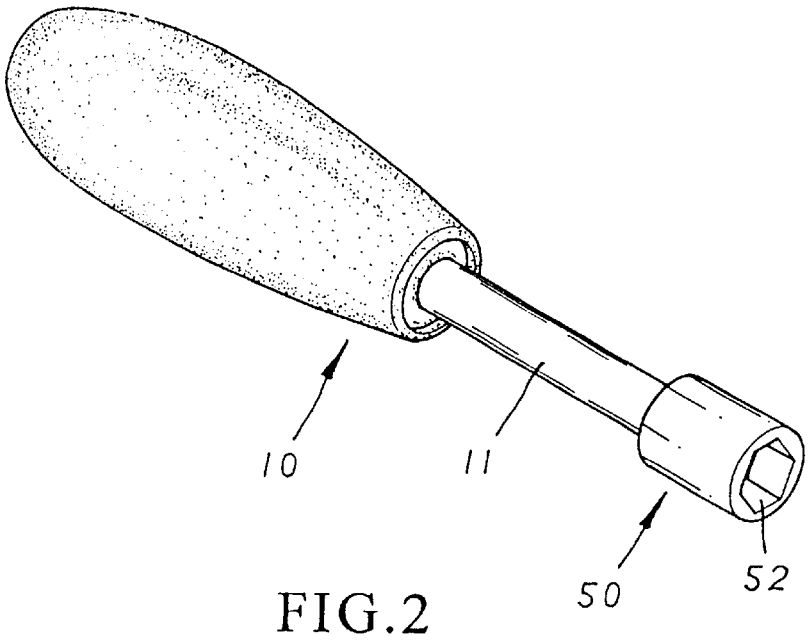
FIG. 2 PRIOR ART
FIG. 2 is a perspective assembled view of the conventional hand tool.
Figure 3:
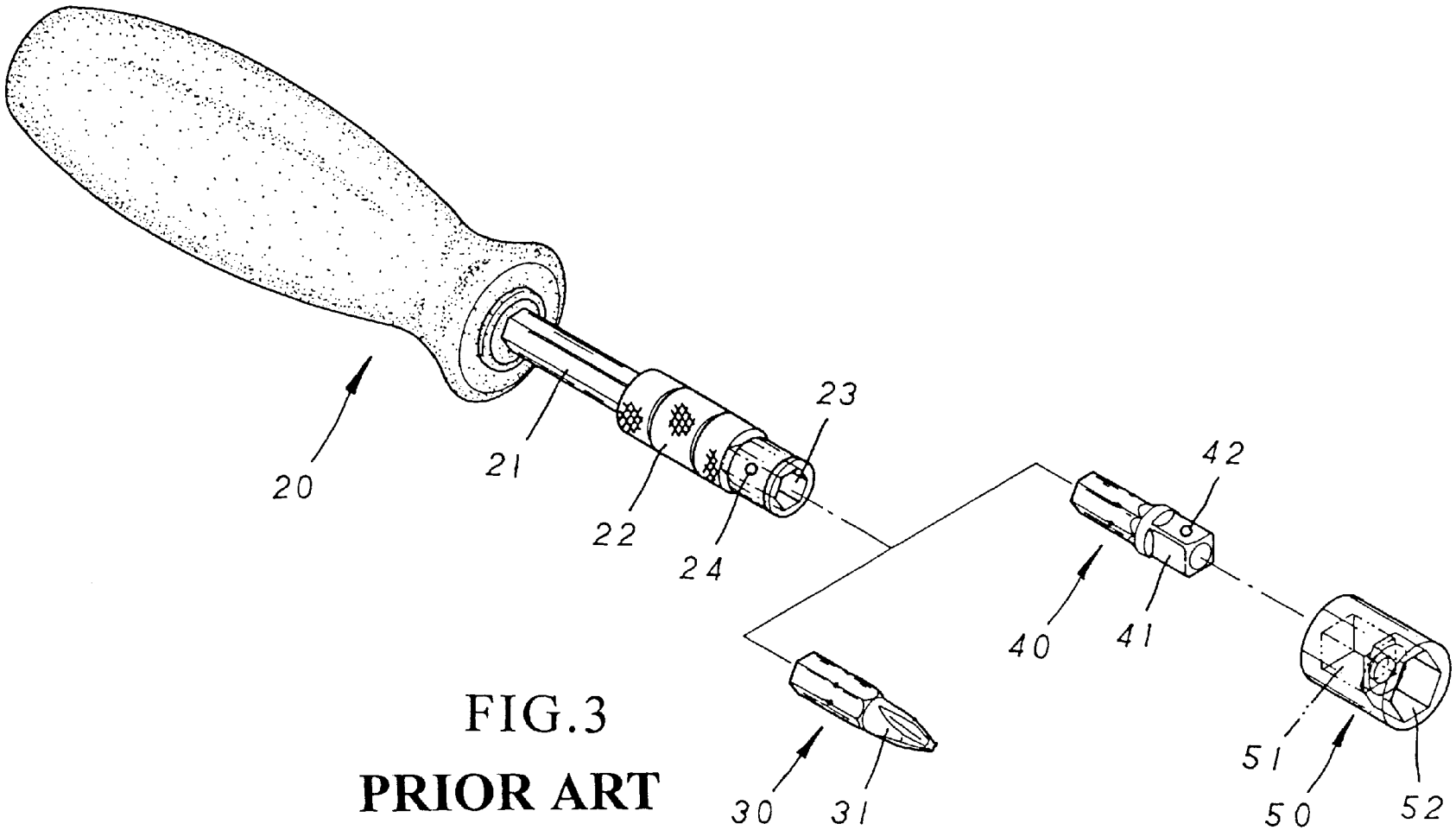
FIG.3 PRIOR ART
FIG. 3 is a perspective exploded view of another type of conventional hand tool.
Figure 4:
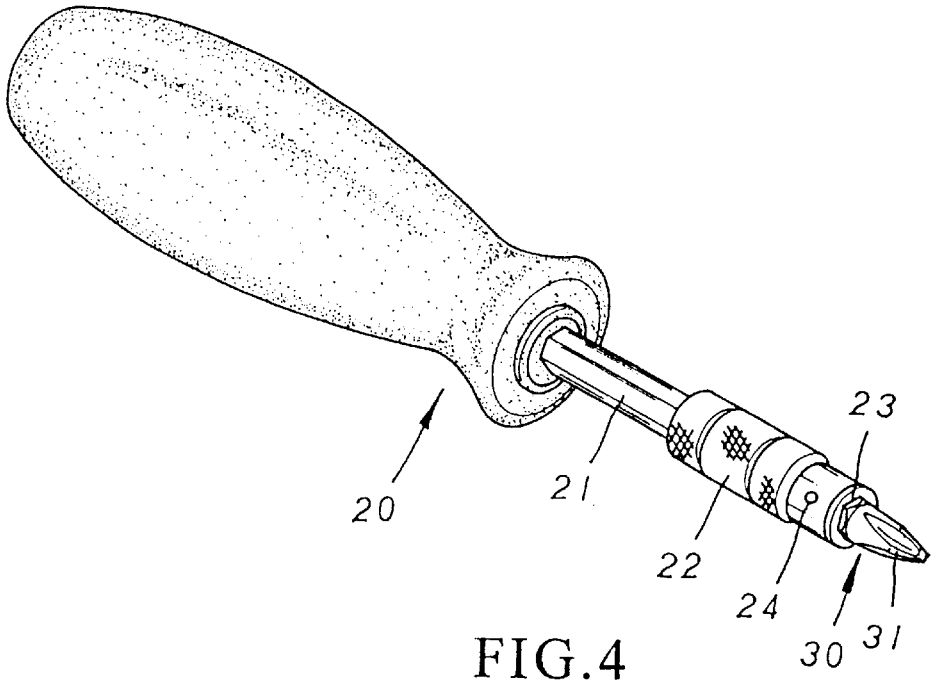
FIG.4 PRIOR ART
FIG. 4 is a perspective assembled view of the conventional hand tool of FIG. 3, showing the use in one state.
Figure 5:
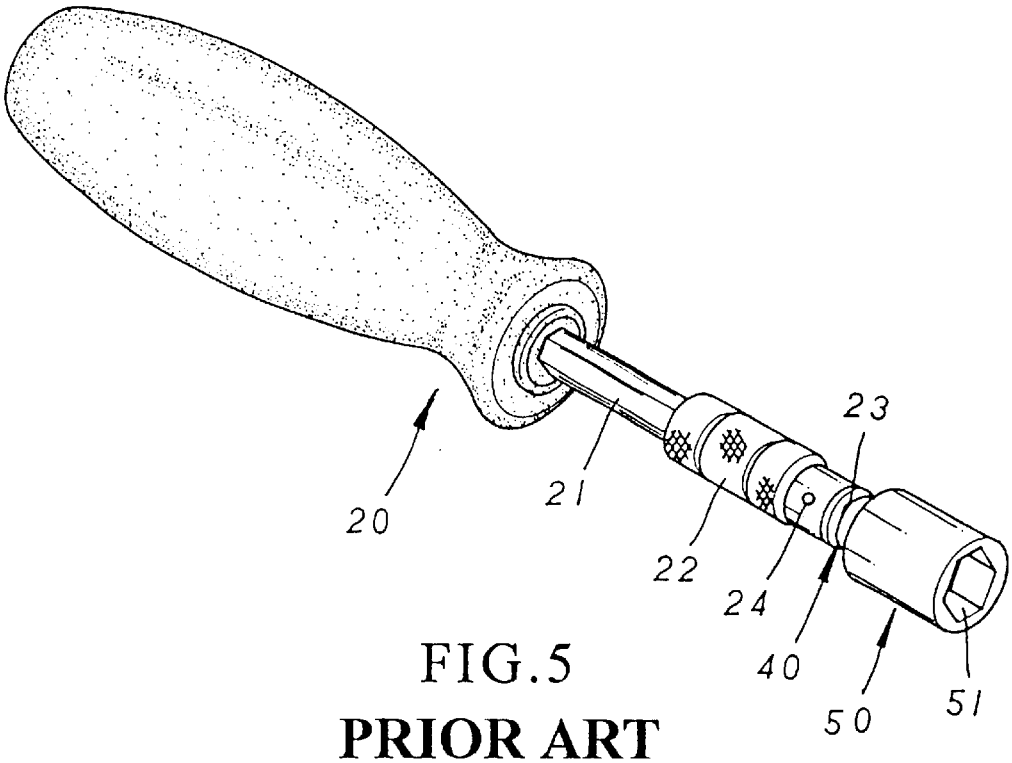
FIG.5 PRIOR ART
FIG. 5 is a perspective assembled view of the conventional hand tool of FIG. 3, showing the use in another state.
Figure 6:
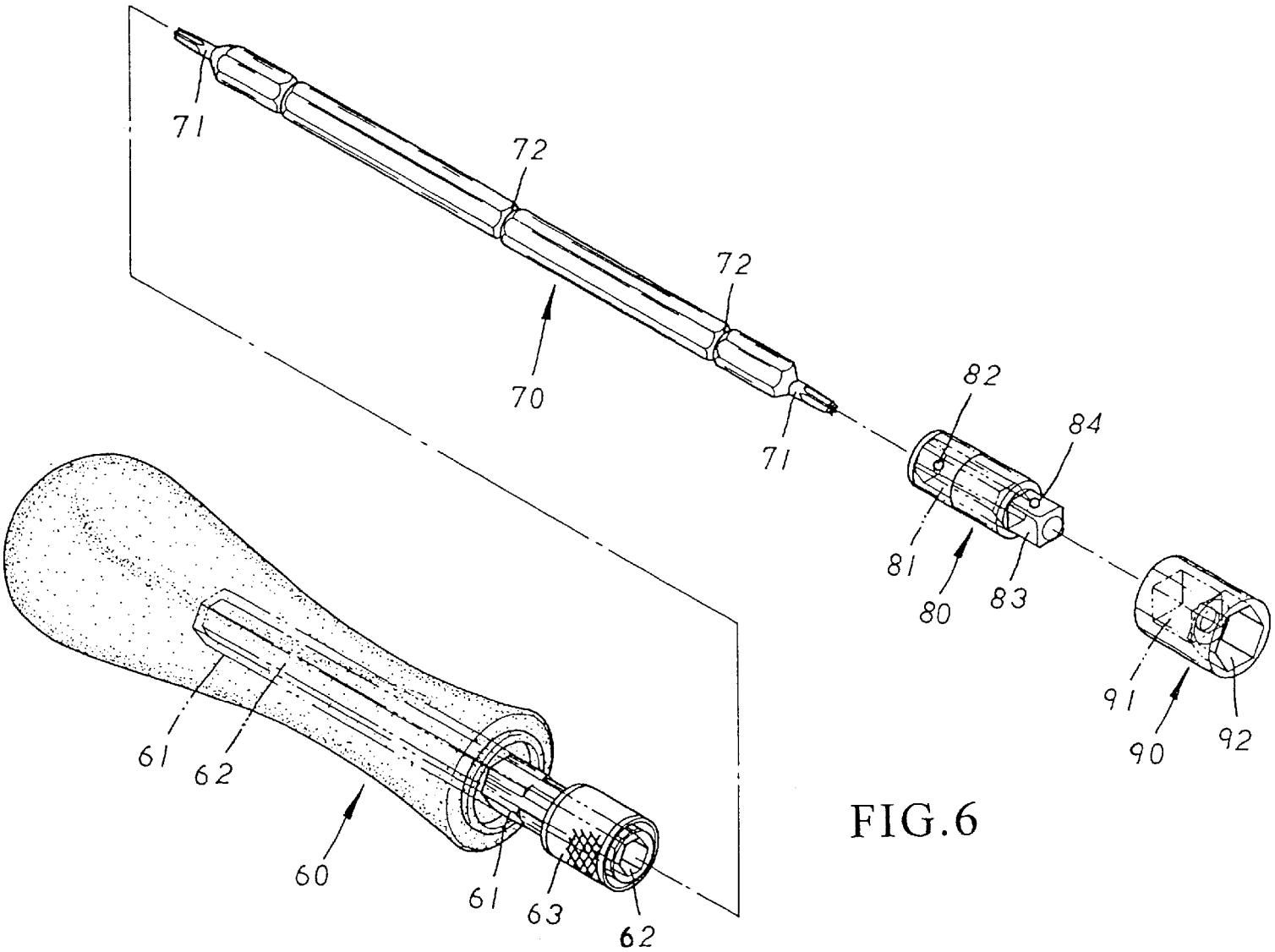
FIG. 6 is a perspective exploded view of the knockdown hand tool of the present invention.
Figure 7:
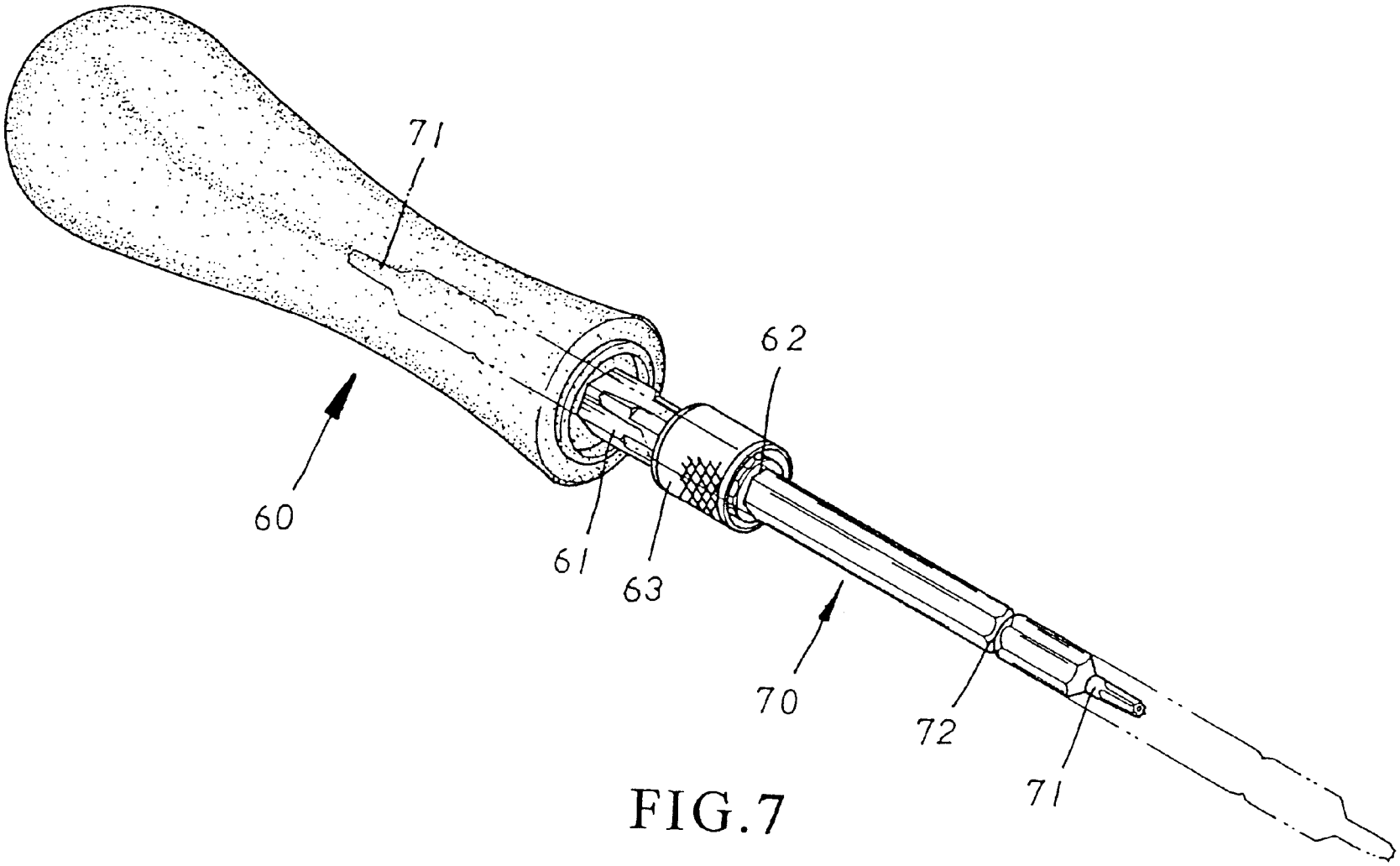
FIG. 7 is a perspective assembled view of the knockdown hand tool of the present invention, showing the adjustment of length of the screwdriver stem thereof.
Figure 7A:
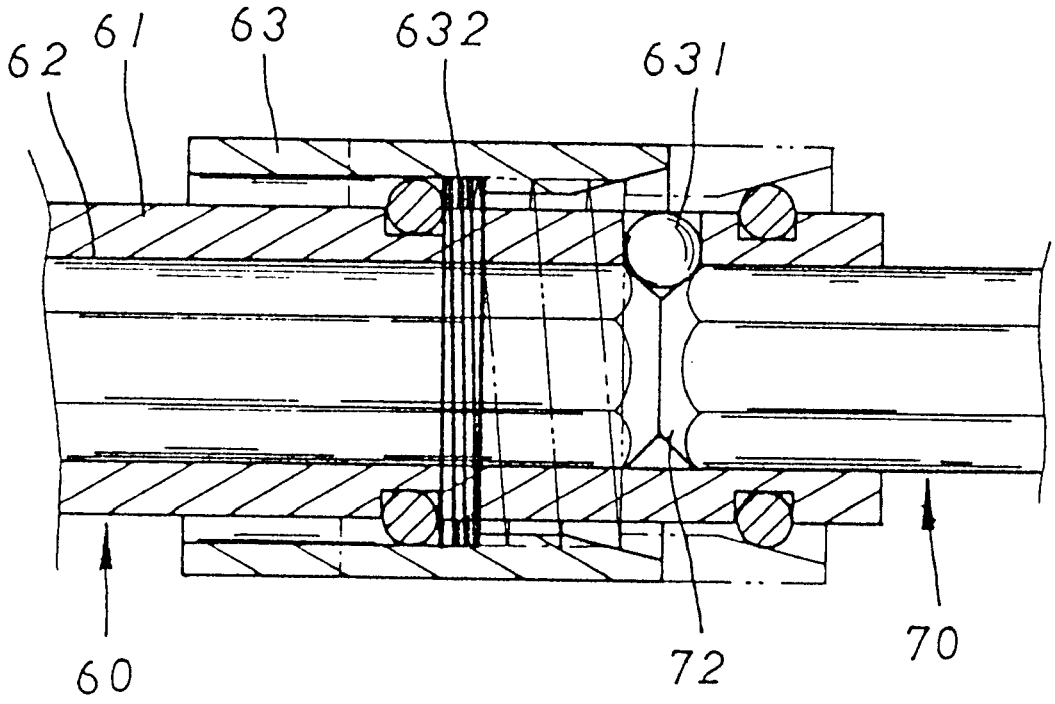

Please refer to FIG. 6. The present invention includes a grip 60, a screwdriver stem 70, a fitting post 80 and a socket 90. A hexagonal elongated stem 61 is implanted in the center of the front end face of the grip 60. The front end of the elongated stem 61 is formed with a central hexagonal fitting hole 62 with a certain depth. A stop sleeve 63 is fitted on the front end of the elongated stem 61. A steel ball 631 and a compression spring 632 are received in the stop sleeve 63 (as shown in FIGS. 7-A). The screwdriver stem 70 is a hexagonal stem body. Two ends of the screwdriver stem 70 are respectively equipped with different specifications or patterns of screwdriver heads 71. Certain portions of the body of the screwdriver stem 70 are formed with annular engaging grooves 72 with V-shaped cross-section and a certain depth at equal intervals. The fitting post 80 is a short cylindrical body. The rear end of the fitting post 80 is formed with a hexagonal fitting hole 81 with a certain depth. A steel ball 82 is inlaid in one side of the fitting hole 81. The front end of the fitting post 80 is formed with a projecting rectangular fitting section 83. A steel ball 84 is inlaid in one side of the fitting section 83. The rear end of the socket 90 is formed with a rectangular fitting hole 91. The front end of the socket 90 is formed with a polygonal tool socket 92.

When assembled, as shown in FIG. 7, the stop sleeve 63 of the grip 60 is first pressed rearward to compress the compression spring 632 in the stop sleeve 63. Then one end of the screwdriver stem 70 is inserted into the fitting hole 62 of the elongated stem 61 of the grip 60. Then the stop sleeve 63 is released, permitting the compression spring 632 to extend and make the steel ball 631 engaged in the V-shaped annular engaging groove 72 of the screwdriver stem 70. Under such circumstance, the screwdriver stem 70 is fixed in the fitting hole 62 of the grip 60 for use of the screwdriver stem 70. In the case that the working space is narrow or the screw is tightened in a deep and narrow hole, the stop sleeve 63 can be pressed rearward to compress the compression spring 632. At this time, a larger space exists between the steel ball 631 in the stop sleeve 63 and the V-shaped annular engaging groove 72 of the screwdriver stem 70. Therefore, the screwdriver stem 70 can be inward or outward moved to make the steel ball 631 engaged in another V-shaped annular engaging groove 72 at necessary position. Accordingly, the length of the screwdriver stem 70 can be changed. In addition, the screwdriver stem 70 can be extracted and turned over to alternatively use the other specification of pattern of screwdriver head 71.

Figure 8:
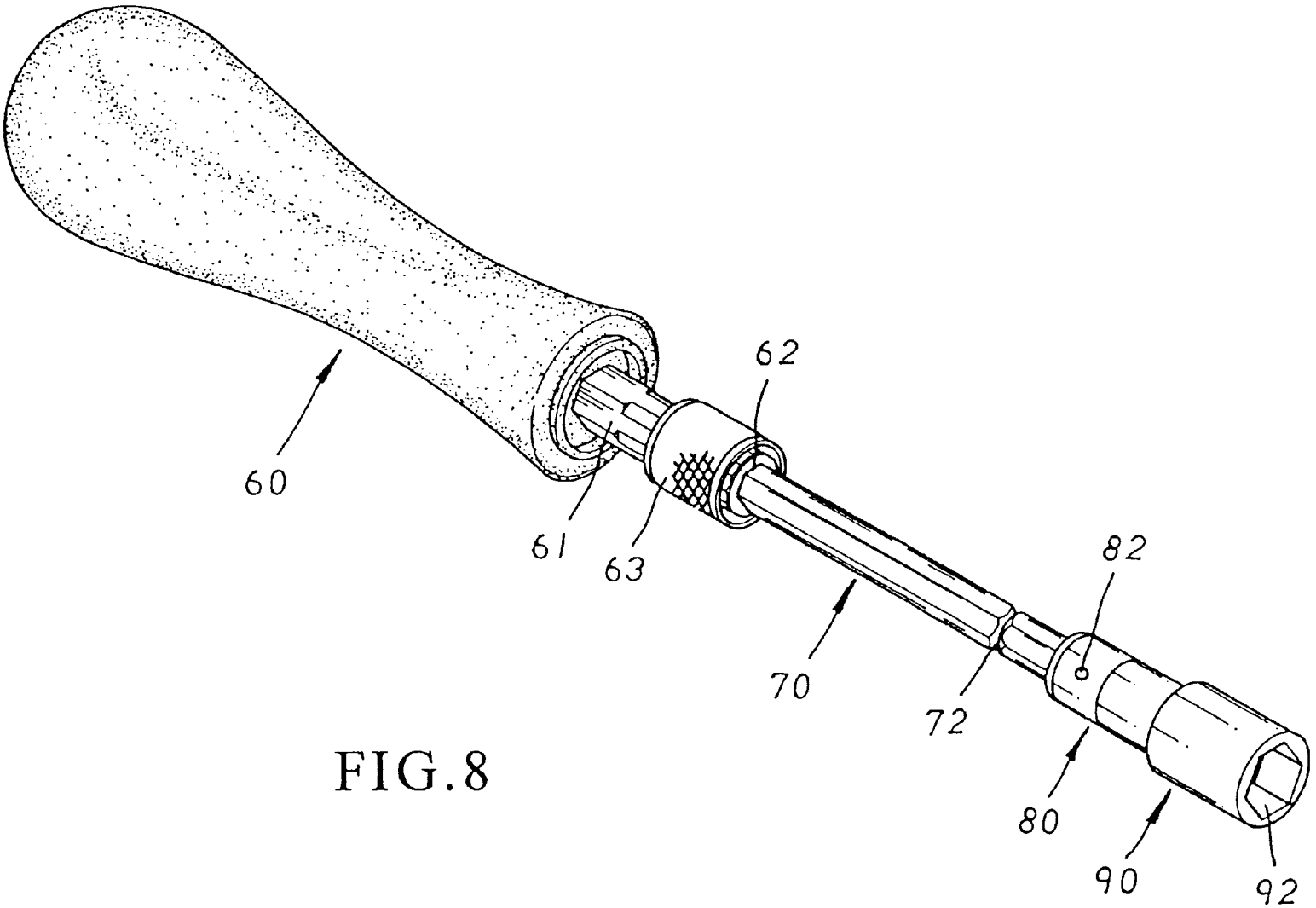
FIG. 8 is a perspective assembled view, showing the use of the socket of the present invention.

When applied to a nut, as shown in FIG. 8, the fitting post 80 and the socket 90 are further fitted on the screwdriver head 71 of the screwdriver stem 70. The end of the screwdriver stem 70 is inserted into the fitting hole 81 of rear end of the fitting post 80. The steel ball 82 in the fitting hole 81 is engaged with the end of the screwdriver stem 70 so as to fix the fitting post 80 on the end of the screwdriver stem 70. Then the fitting section 83 of the fitting post 80 is inserted into the fitting hole 91 of the socket 90. By means of the steel ball 84 of the fitting section 83, the socket 90 is fixed on the fitting post 80 for use of the socket 90. When replacing the socket 90, the socket 90 is directly extracted outward and separated from the fitting post 80 and replaced with another socket 90 with different length, specification or pattern.

According to the above arrangement, the present invention has the following advantages:

1. In the case that the screw is tightened in a narrower hole, the body of the screwdriver stem 70 is slender and has unified diameter so that the screwdriver stem 70 can easily extend into the narrower hole to drive the screw.
2. The fitting post 80 and the socket 90 are fitted on the screwdriver head 71 of the screwdriver stem 70. In the case that it is desired to further use the screwdriver stem 70 after using the socket 90, a user only needs to extract the fitting post 80 and the socket 90 and then the screwdriver stem 70 can be directly used. Therefore, it is no more necessary to extract the socket 90 and then insert the screwdriver stem 70 and the replacement is facilitated and quickened.
3. In use, the screwdriver stem 70 can be directly inward or outward moved to change the length thereof as necessary. Alternatively, the screwdriver stem 70 can be extracted and turned over to use the other screwdriver head 71 with different specification or pattern. Therefore, the use is facilitated and it is unnecessary to purchase additional screwdriver stem 70 so that the cost is saved and the occupied space is reduced to facilitate carriage of the hand tool.

The above embodiment is only used to illustrate the present invention, not intended to limit the scope thereof. Many modifications of the above embodiment can be made without departing from the spirit of the present invention.

What is claimed is:

1. A knockdown hand tool structure comprising:

a grip;

a screwdriver stem;

a fitting post;

a socket;

a hexagonal elongated stem implanted centrally at a front end face of the grip;

a rear end of the socket comprising a rectangular fitting hole;

a front end of the socket comprising a polygonal tool socket;

a front end of the elongated stem comprising a central hexagonal fitting hole;

a stop sleeve being fitted on the front end of the elongated stem;

the screwdriver stem comprising a hexagonal stem body;

two ends of the screwdriver stem comprising different shaped screwdriver heads;

the screwdriver stem comprising annular engaging grooves each with V-shaped cross-section and a depth at equal intervals;

the fitting post comprising a short cylindrical body;

a rear end of the fitting post comprising a hexagonal fitting hole;

a first steel ball inlaid in one side of the hexagonal fitting hole;

a front end of the fitting post comprising a projecting rectangular fitting section;

a second steel ball inlaid in one side of the rectangular fitting section;

the screwdriver stem fixedly inserted into the fitting hole of the elongated stem of the grip, whereby by the V-shaped annular engaging grooves of the screwdriver stem, a projecting length of the stem can be changed for application to various holes with different depths and diameters so as to permit tightening or untightening of a screw therein when applied to a nut; and the fitting post and the socket being fitted over the screwdriver heads of the screwdriver stem.

2. The knockdown hand tool as claimed in claim 1, wherein an end of the screwdriver stem is secured in the polygonal fitting hole of the fitting post.

3. The knockdown hand tool as claimed in claim 1, wherein a movable steel ball and a compression spring are received in a stop sleeve fitted on an end of the elongated stem of the grip, whereby when the screwdriver stem is adjusted in length, the stop sleeve is pulled inwards to compress the compression spring and release the movable steel ball, permitting the screwdriver stem to be adjusted in length and after the adjustment, the stop sleeve is released to permit the compression spring to extend so that the stop sleeve is again engaged with the movable steel ball to make the movable steel ball to be engaged in a second V-shaped annular engaging groove of the screwdriver stem and thereby fixedly locate the screwdriver stem without sliding.

* * * * *